US010920560B2

(12) United States Patent
Raglin

(10) Patent No.: US 10,920,560 B2
(45) Date of Patent: Feb. 16, 2021

(54) HORIZONTAL GAS AND LIQUID BYPASS SEPARATOR

(71) Applicant: WellWorx Energy Solutions LLC, Midland, TX (US)

(72) Inventor: John M. Raglin, Fredericksburg, TX (US)

(73) Assignee: WellWorx Energy Solutions LLC, Midland, TX (US)

( * ) Notice: Subject to any disclaimer, the term of this patent is extended or adjusted under 35 U.S.C. 154(b) by 0 days.

(21) Appl. No.: 16/856,186

(22) Filed: Apr. 23, 2020

(65) Prior Publication Data

US 2020/0340349 A1 Oct. 29, 2020

Related U.S. Application Data

(60) Provisional application No. 62/838,082, filed on Apr. 24, 2019.

(51) Int. Cl.
*E21B 43/38* (2006.01)
*E21B 34/08* (2006.01)

(52) U.S. Cl.
CPC ..... *E21B 43/38* (2013.01); *E21B 34/08* (2013.01); *E21B 2200/04* (2020.05)

(58) Field of Classification Search
CPC ..... E21B 43/38; E21B 43/128; E21B 43/12; E21B 43/121; E21B 34/08; E21B 2200/04
See application file for complete search history.

(56) References Cited

U.S. PATENT DOCUMENTS 6,715,556 B2 * 4/2004 Mack ..... E21B 43/121 166/105
7,240,739 B2 * 7/2007 Schoonderbeek ..... E21B 43/12 166/386
7,270,178 B2 * 9/2007 Selph ..... E21B 43/128 166/105.5
7,921,908 B2 * 4/2011 Tetzlaff ..... E21B 43/38 166/108
7,980,314 B2 * 7/2011 Mack ..... E21B 34/06 166/369
2002/0059866 A1 5/2002 Grant et al.
2006/0196655 A1 9/2006 Wang
2010/0096140 A1 4/2010 Mack
(Continued)

OTHER PUBLICATIONS

International Search Report and Written Opinion dated Jun. 26, 2020 for International Application No. PCT/US2020/029678, 14 pages.

*Primary Examiner* — Michael R Wills, III
(74) *Attorney, Agent, or Firm* — Frost Brown Todd LLC

(57) ABSTRACT

A horizontal gas and liquid bypass separator for use in a hydrocarbon producing well bore is provided for allowing gas to bypass over the top of a pump intake in a horizontal portion of a well bore. The separator includes at least one valve having a body, a conduit extending longitudinally through the body, a channel extending transversely through the body from an outer surface of the body to the conduit, and a plunger positioned within the conduit. The plunger is translatable within the channel to selectively seal the conduit relative to the channel to thereby inhibit gas from entering the conduit when the plunger is translated to a closed position and to allow liquid to flow within the conduit when the plunger is translated to an open position.

11 Claims, 12 Drawing Sheets

(56) References Cited

U.S. PATENT DOCUMENTS

| | | | | |
|---|---|---|---|---|
| 2014/0369868 | A1 | 12/2014 | Tetzlaff et al. | |
| 2015/0204169 | A1 | 7/2015 | Coates et al. | |
| 2016/0281486 | A1 | 9/2016 | Obrejanu | |
| 2017/0306738 | A1* | 10/2017 | Voll | F16K 15/023 |

* cited by examiner

HORIZONTAL GAS AND LIQUID BYPASS SEPARATOR

CROSS REFERENCE TO RELATED INFORMATION

This application claims the benefit of U.S. Provisional Patent Application No. 62/838,082, filed Apr. 24, 2019, titled Horizontal Gas and Liquid Bypass Separator, the contents of which are hereby incorporated herein in its entirety.

TECHNICAL FIELD

The present disclosure is directed to an apparatus and method for petroleum producing and injection wells and more particularly to the separation of gas and liquid from a hydrocarbon production stream.

BACKGROUND OF THE INVENTION

A petroleum well is a boring in the earth that is designed to bring petroleum oil hydrocarbons to the surface. In some versions, a well bore of a petroleum well may have a vertical portion extending in a generally vertical direction and a horizontal portion extending in a generally horizontal direction. For instance, as shown in FIG. 1, a well bore (10) may include a generally vertical portion (12) extending downward from the earth's surface (24) and a generally horizontal portion (14) extending outward and transversely relative to the generally vertical portion (12). A generally curved portion (16) may be positioned between the generally vertical portion (12) and the generally horizontal portion (14) that is generally curved to transition the well bore (10) from the generally vertical portion (12) to the generally horizontal portion (16). A well bore (10) may include one or more of a generally vertical portion (12), a generally horizontal portion (14), and a generally curved portion (16) that are joined to form the well bore (10).

The pressure of the well liquids and well gasses within the well bore may be insufficient to cause the liquid and gas to flow naturally to the surface, in such a circumstance, some form of artificial lift may be required to deliver well liquids to the surface. Such artificial lift in a production well may be produced by, but is not limited to, an electrical submersible pump (ESP), a sucker rod pump, a progressing cavity pump, a plunger-lift, and/or a gas injection lift. Referring back to FIG. 1, an ESP system may include an electric motor (30) and a pump (42) that is used to pump oil or other liquids within the well bore (10). The electric motor (30) may have a rotatable rotor that is contained in a stationary stator. When the motor (30) operates, the rotor may rotate to provide artificial lift within the well bore (10). Accordingly, an ESP system may be configured to move liquids from the horizontal portion (14) and/or the generally curved portion (16) of the well bore (10) up to the surface (24) and/or well head (20) via a tubing string (40) that discharges to the surface (24).

Where the product flowing into the well bore contains entrained and free gas, that gas can enter the pump and reduce the volumetric efficiency of the pump. For instance, the hydrocarbon production stream can include both liquid and gaseous products that are a natural byproduct of the producing wells. As hydrocarbons and water flow through the formation, gases can travel in the flow stream either separate from the liquid products or dissolved within the liquid products. The gases are carried into the production tubing and can cause problems for an artificial lifting mechanism, such as ESP systems, by reducing the volumetric efficiency of the pump. Gas interference occurs in situations when the pump is filling with a considerable amount of free gas that is not separated from the liquid before entering the pump. If the amount of free gas entering the pump can be reduced, the volumetric efficiency of the pump can be improved, or the total pumping capacity can be increased.

One common attempt to decrease the amount of free gas entering the pump in a horizontal well bore is to lower a tail-pipe type tubing string or velocity string into the well bore below the pump and try to draw liquids directly off the bottom of the horizontal portion. Referring to FIG. 1, a tubing string (40) may be positioned below the pump (42) through the generally curved portion (16) and/or the horizontal portion (14). In the well bore, a natural separation typically occurs between the liquid and gas such that liquids exist near the bottom of the well bore and gas exists near the top of the well bore. The tubing string is typically installed between the pump suction and the intake with an open end that is laid in the horizontal portion of the well bore. The tubing string may thereby allow gas to bypass the top of the open end of the tubing string and allow liquids to enter the tubing string gas free. This is an attempt to increase the fluid velocity as the liquids move toward the pump to increase pump productivity. In some instances, due to either the slow fill rate of liquid in the horizontal portion of the well or the high percentage of gas in the well product, there may be a combination of liquid and gas in the horizontal portion of the well bore with free gas at the top of the horizontal bore and liquid at the bottom. In this case, the liquid level within the horizontal portion of the well bore may fall below the open end of the tubing string, which may still allow gas to enter the pump and decrease the efficiency of the pump. Accordingly, there remains a need to aid this process to better allow the well string to draw liquid from a horizontal or curved portion of a well bore to improve pump efficiency and extend the life of the pump assembly regardless of the artificial lift methodology.

BRIEF SUMMARY OF THE INVENTION

An exemplary separator for use in a well bore may comprise at least one valve. The at least one valve may comprise a body extending along a longitudinal axis from a first end to a second end of the body, a conduit extending longitudinally through the body from the first end to the second end of the body, a channel extending laterally through the body from an outer surface of the body to the conduit, and a plunger positioned within the channel such that the plunger is translatable inwardly and outwardly within the channel to selectively seal the conduit relative to the channel. The plunger may be translatable inward within the channel towards the longitudinal axis to a closed position such that the plunger substantially seals the conduit relative to the channel to thereby inhibit gas from entering the conduit. The plunger may also be translatable outward within the channel away from the longitudinal axis to an open position such that the plunger substantially opens the conduit relative to the channel to thereby allow liquid to enter the conduit.

An exemplary separator for use in a well bore may comprise a first valve and a second valve coupled together along a longitudinal axis of the separator. Each of the first and second valves may comprise a body extending along the longitudinal axis from a first end to a second end of the body, a conduit extending longitudinally through the body from the first end to the second end of the body, a channel extending laterally through the body from an outer surface of the body to the conduit, and a plunger positioned within the channel such that the plunger is translatable inwardly and outwardly within the channel to selectively seal the conduit relative to the channel. The plunger may be translatable inward within the channel towards the longitudinal axis to a closed position such that the plunger substantially seals the conduit relative to the channel, and the plunger may be translatable outward within the channel away from the longitudinal axis to an open position such that the plunger substantially opens the conduit relative to the channel. The first valve may rotationally offset relative to the second valve about the longitudinal axis such that the first valve is positioned in the closed position when the second valve is positioned in the open position.

An exemplary well bore assembly may comprise a well bore having a generally vertical portion and a generally horizontal portion extending transversely relative to the generally vertical portion, a tubing string extending through at least a portion of the well bore, an artificial lift having a pump coupled with the tubing string, wherein the pump is configured to pump fluid through the tubing string, and a separator coupled with an end of the tubing string. The separator may comprise at least one valve having a body extending along a longitudinal axis from a first end to a second end of the body, a conduit extending longitudinally through the body from the first end to the second end of the body, wherein the conduit is fluidly coupled with the tubing string, at least one channel extending laterally through the body from an outer surface of the body to the conduit, and a plunger positioned within the at least one channel such that the plunger is translatable inwardly and outwardly within the at least one channel to selectively seal the conduit relative to the at least one channel. The separator may be positioned within a bottom portion of the well bore, wherein the separator is configured to allow gas within the well bore to bypass a top portion of the separator, and wherein the separator is configured to allow liquid within the well bore to flow within a bottom portion of the separator and to the pump via the tubing string.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
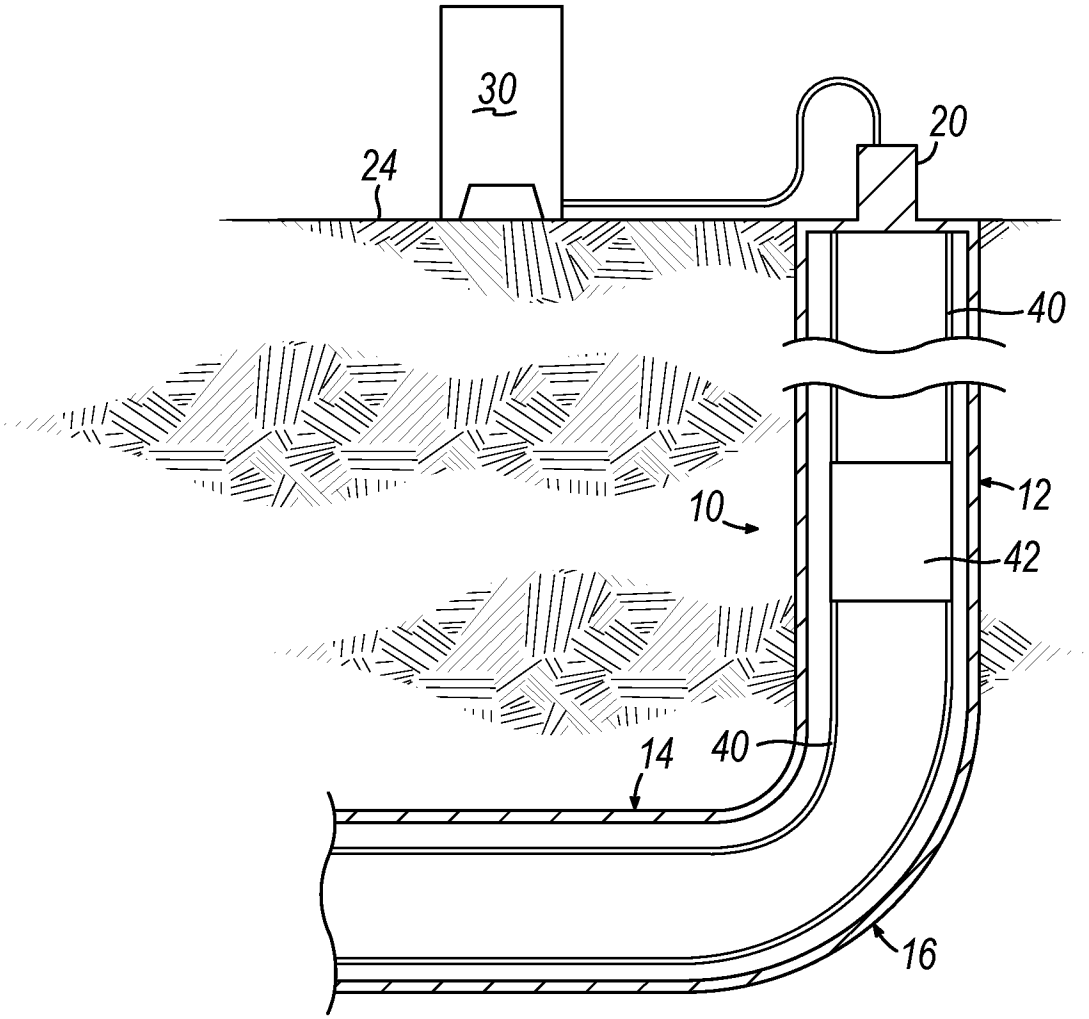
FIG. 1 PRIOR ART
FIG. 1 is a schematic of a well bore having a generally vertical portion and a generally horizontal portion.

Preferred embodiments of a horizontal gas and liquid bypass separator for a hydrocarbon producing well provide mechanisms for allowing gas to bypass over the top of a pump intake in a horizontal portion of a well bore. These mechanisms use a tail-pipe type separator to reduce and/or eliminate free gas from entering the pump of an artificial lift system. Any type of artificial lift system applicable to any producing oil well may be used, such as a sucker rod pump, rod pumping, electric submersible pumps, progressive cavity, and other suitable methods.

I. Exemplary Well Bore Assembly Having a Horizontal Gas and Liquid Bypass Separator Referring to FIG. 2, a well bore (10) of a petroleum well includes a generally vertical portion (12) extending downward from the surface (24) and a generally horizontal portion (14) extending transversely away from the generally vertical portion (12). A generally curved portion (16) is positioned between the generally vertical portion (12) and the generally horizontal portion (14) that is generally curved to transition the well bore (10) from extending in a generally vertical direction to a generally horizontal direction. The horizontal portion (14) may include one or more openings (18) to allow gas and liquid products to enter the well bore (10). In the well bore (10), some gas may naturally separate from the liquid such that liquids (54) exist near the bottom of the well bore (10) and gas (52) exists near the top of the well bore (10). In the illustrated embodiment, an ESP system is used as an artificial lift to deliver well liquids to the surface. The ESP system includes an electric drive (30), or motor, and a submersible pump (42) positioned within the well bore (10). The electric motor (30) may have a rotatable rotor that is contained in a stationary stator. When the motor (30) operates, the rotor may rotate to provide artificial lift within the well bore (10).

Figure 2:
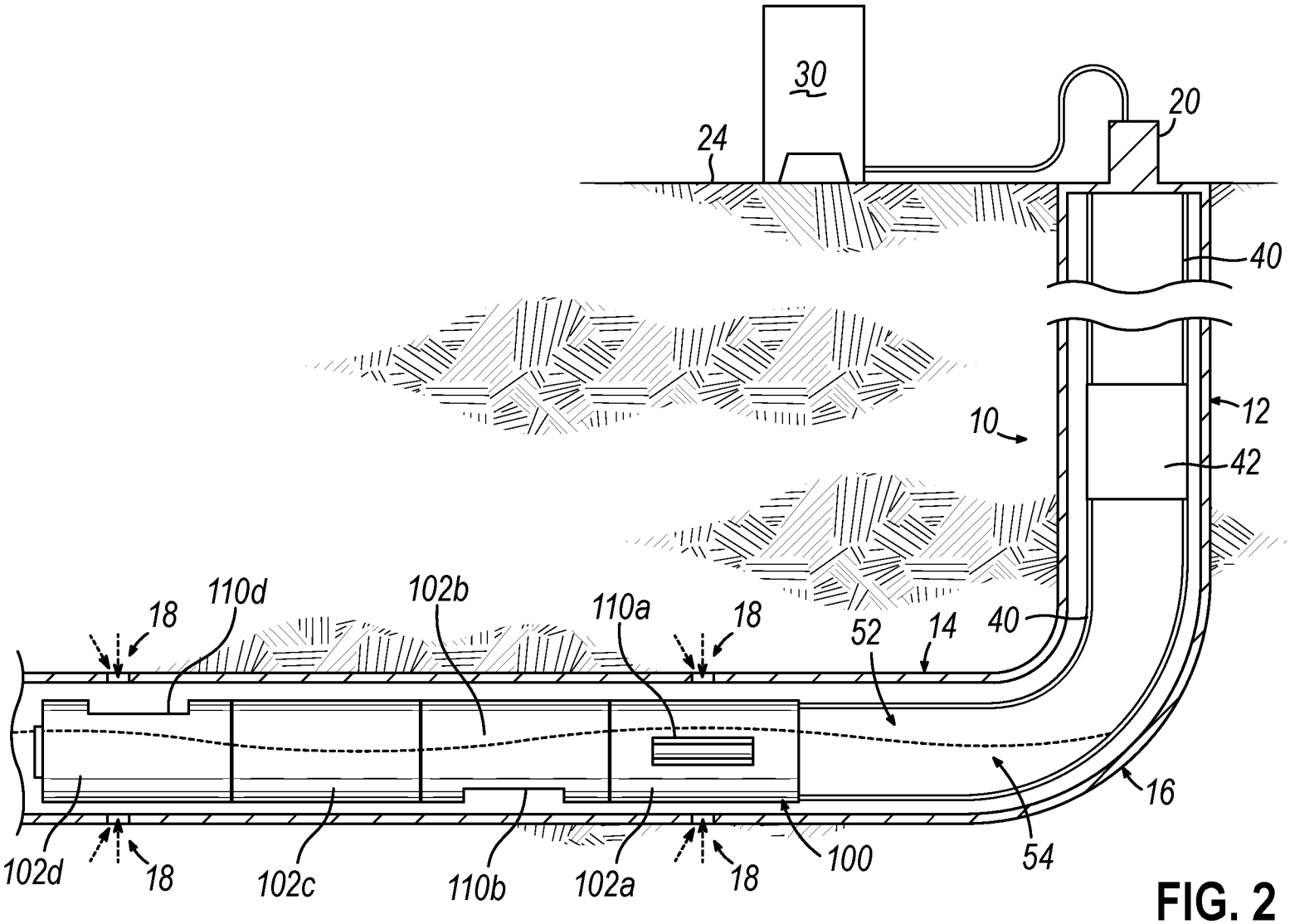
FIG. 2 is a schematic of the well bore of FIG. 1 having a first exemplary horizontal gas and liquid bypass separator positioned within the generally horizontal portion of the well bore.

As shown in FIG. 2, a tubing string (40) is positioned above the pump (42) of the ESP to move liquids (54) from the well bore (10) up to the surface (24) and/or the well head (20). Another tubing string (40) is then positioned below the pump (42) and extends through the generally vertical portion (12) and the generally curved portion (16), into the generally horizontal portion (14) of the well bore (10). A horizontal gas and liquid bypass separator (100) is coupled to the open end of the tubing string (40) in the generally horizontal portion (14) of the well bore (10). Accordingly, the separator (100) can be deployed below a velocity or tubing string in such a manner to increase the fluid velocity up the tubing of the well to aid production from low pressure reservoirs.

Figure 3:
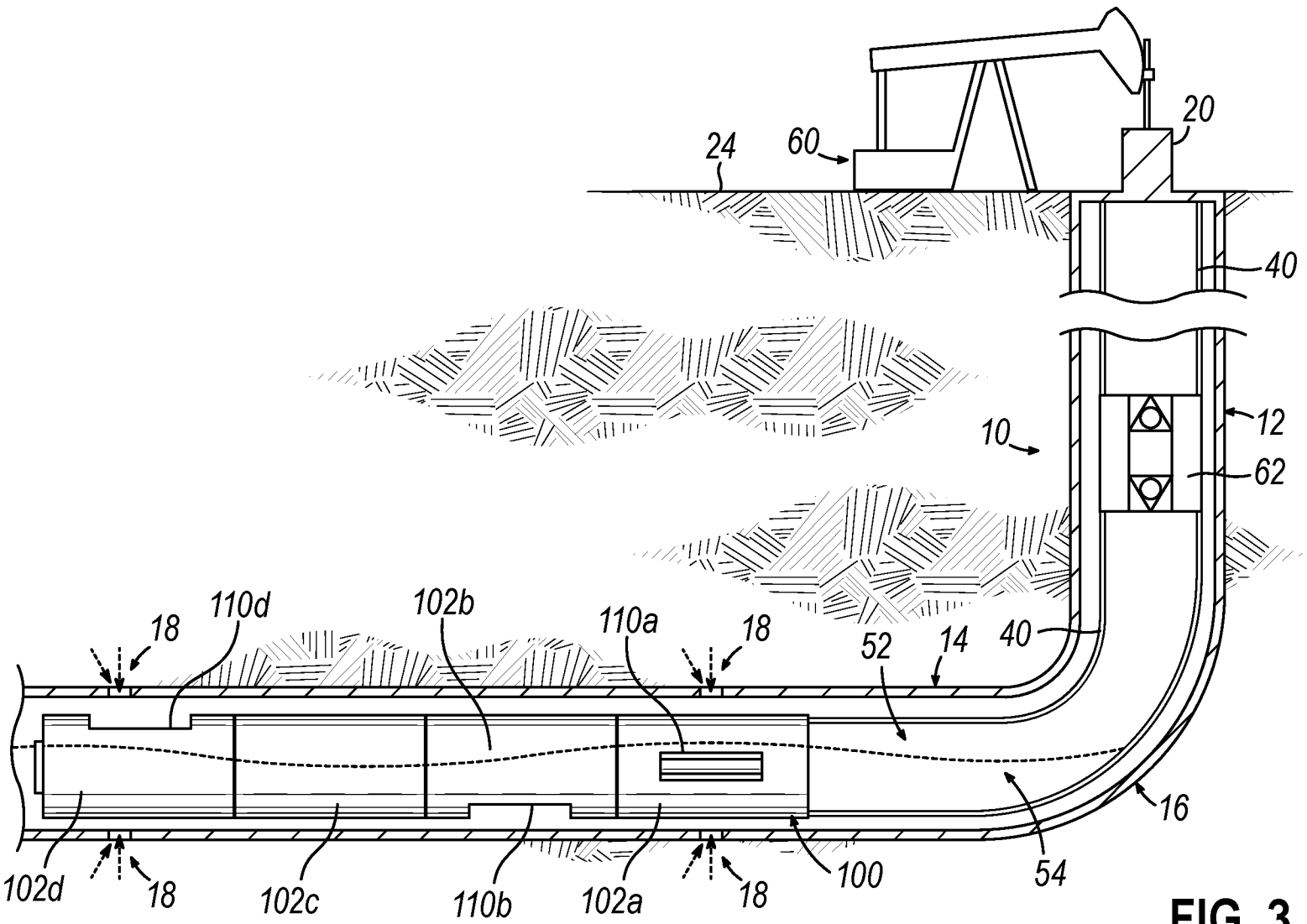
FIG. 3 is a schematic of the well bore of FIG. 2 having a rod pump system for pumping liquid therethrough.

In some other versions, a rod pump system or other artificial lift system may be used. Referring to FIG. 3, a rod pump system is shown having a beam and crank assembly (60) that creates reciprocating motion in the tubing string (40) that connects to the pump (62). The pump (62) may include a plunger and a valve assembly to convert the reciprocating motion to fluid movement within the tubing string (40). Still other suitable configurations for the artificial lift system will be apparent to one with ordinary skill in the art in view of the teachings herein.

A. Exemplary Horizontal Gas and Liquid Bypass Separator

Figure 4:
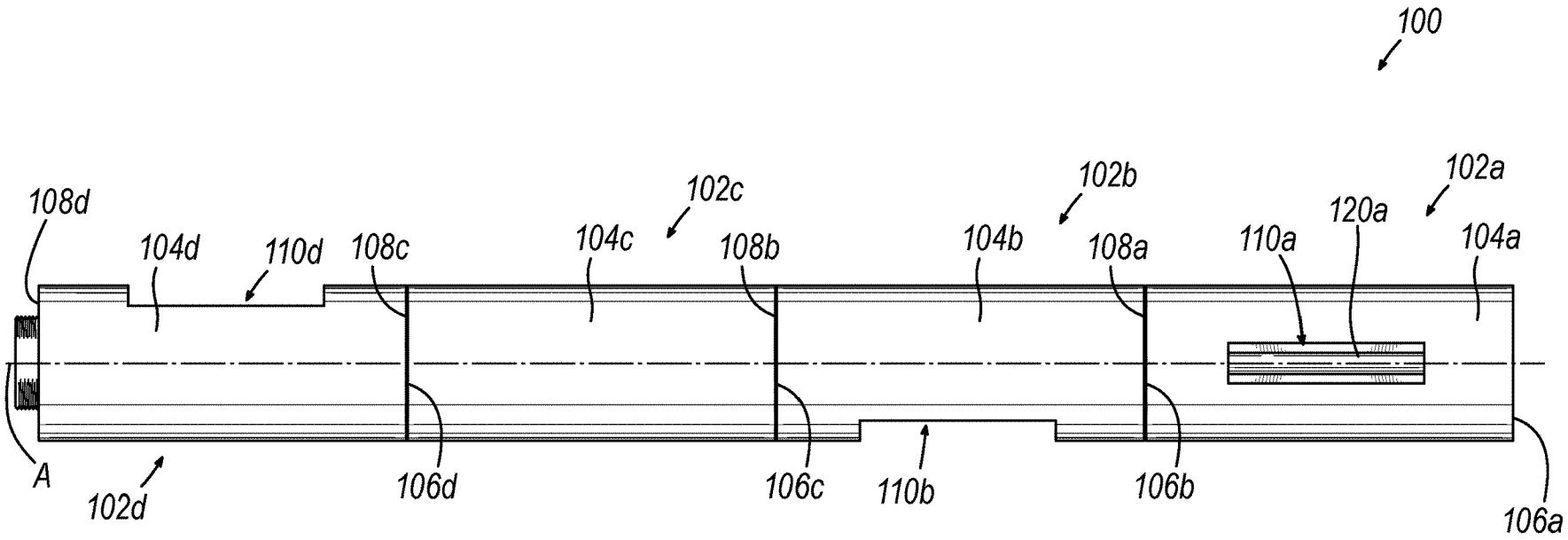
FIG. 4 is a front view of the horizontal gas and liquid bypass separator of FIG. 2.

Referring now to FIG. 4, a first exemplary horizontal gas and liquid bypass separator (100) according to the concepts described herein is shown for use in a hydrocarbon producing well. The separator (100) comprises one or more valves (102*a*, 102*b*, 102*c*, 102*d*) aligned along a longitudinal axis (A) of the separator (100). Each of the one or more valves (102*a*, 102*b*, 102*c*, 102*d*) of the separator (100) may be rotationally offset relative to each other along the longitudinal axis (A). In the illustrated embodiment, four valves (102*a*, 102*b*, 102*c*, 102*d*) are assembled with each other along the longitudinal axis (A) such that each valve is rotated about 90 degrees relative to an adjacent valve about the longitudinal axis (A). As shown in FIG. 4, a first valve (102*a*) is positioned at about 90 degrees, a second valve (102*b*) is positioned at about 180 degrees, a third valve (102*c*) is positioned at about 270 degrees, and a fourth valve (102*d*) is positioned at about 0 degrees. Still other suitable configurations for assembling one or more valves will be apparent to one with ordinary skill in the art in view of the teachings herein. For instance, the separator (100) may include one or more valves (102*a*, 102*b*, 102*c*, 102*d*) that are rotationally offset relative to each other at any suitable number of degrees from about 0 degrees to about 360 degrees.

Figure 6:
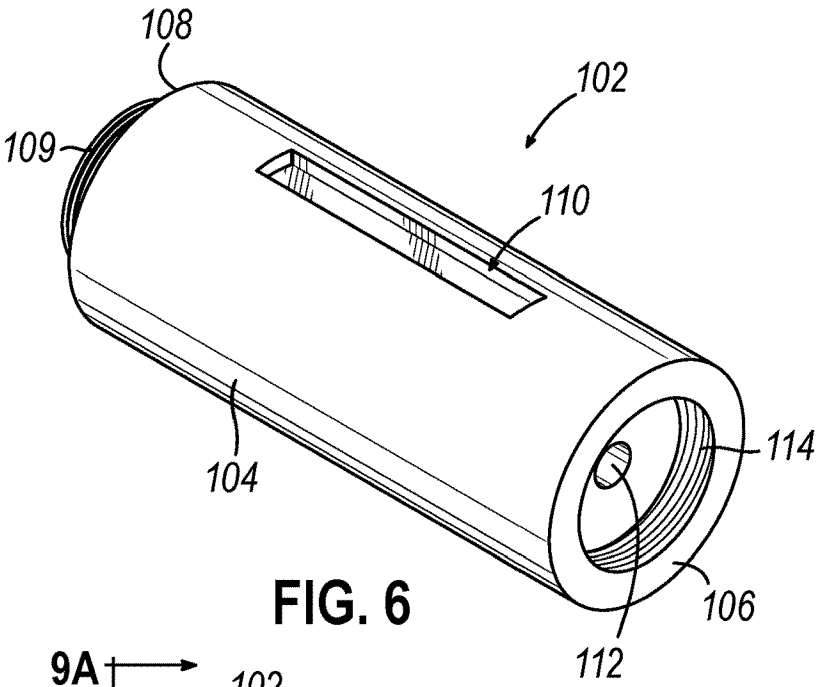
FIG. 6 is a right side perspective view of the valve of FIG. 5.
Figure 5:
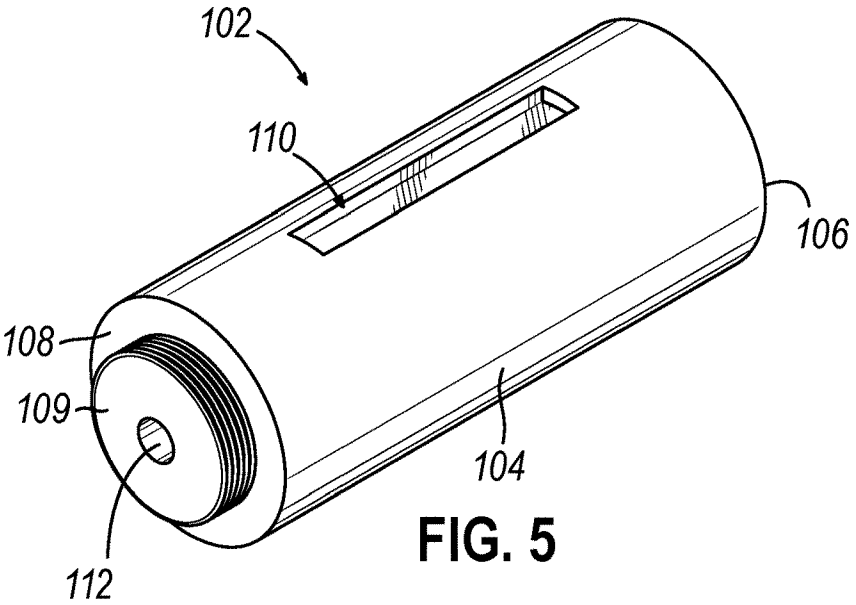
FIG. 5 is a left side perspective view of a first exemplary valve of the horizontal gas and liquid bypass separator of FIG. 4.
Figure 7:
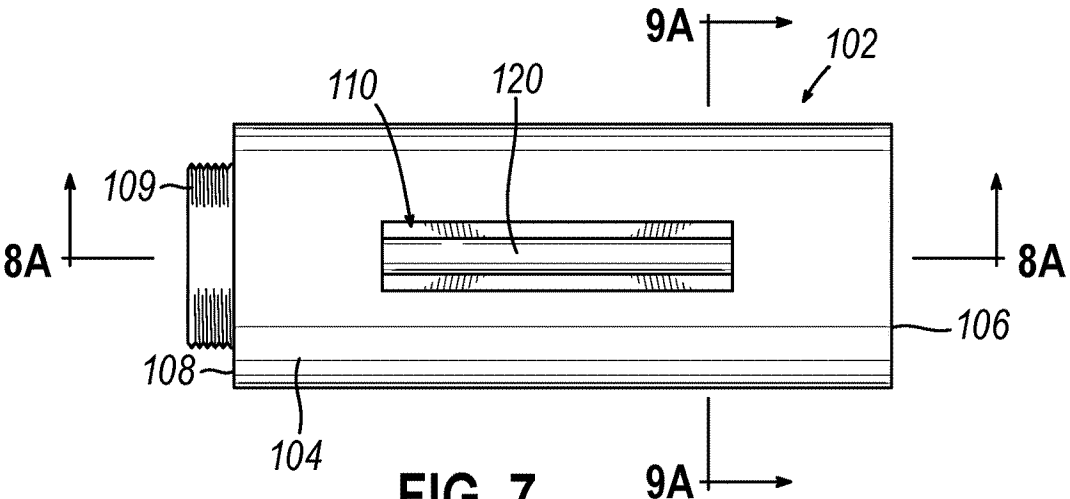
FIG. 7 is a top plan view of the valve of FIG. 5.

Referring to FIGS. 5-7, a first exemplary valve (102) is shown according to the concepts described herein for use in the separator (100). While a single valve (102) is described below, it should be noted that the description of the valve (102) may apply to each of the valves (102*a*, 102*b*, 102*c*, 102*d*) of the separator (100). In the illustrated embodiment, valve (102) comprises a body (104) defining a conduit (112) extending longitudinally therethrough from a first end (106) of the valve (102) to a second end (108) of the valve (102). The body (104) of the valve (102) may have a length of about 3 feet and an outer diameter from about 2 to about 4 inches, such as about 3 inches, though other suitable dimensions may be used. The conduit (112) may have a diameter from about 25% to about 95% of the diameter of the body (104), such as about 33%. For instance, the conduit (112) may have a diameter of about 1 inch, though other suitable dimensions may be used.

The first end (106) may include a recess (114) extending inward from the first end (106) within a portion of the body (104). The second end (108) may include a protrusion (109) extending outward from the second end (108). The protrusion (109) and recess (114) may be sufficiently sized such that the recess (114) is configured to receive a protrusion (109) from an adjacent valve (102) to assemble the valves (102) together. Accordingly, each valve (102) may be selectively coupled with another valve (102). In the illustrated embodiment, the recess (114) and the protrusion (109) are threaded such that the recess (114) may be threadably secured to a protrusion (109) to maintain the rotational position of the recess (114) relative to the protrusion (109). Still other suitable couplings can be used to assembly adjacent valves (102) together, such as a friction fit, a keyed coupling, etc. The valve (102) may be made from stainless steel, or any other suitable material.

The valve (102) further comprises a channel (110) extending inward through at least a portion of the body (104) from an exterior surface of the valve (102) to the conduit (112). The channel (110) may have a length that extends from about 50% to about 100% of the length of the valve (102), such as from about 50% to about 67%. In some versions, the channel has a length from about 1.5 feet to about 2 feet, though other suitable dimensions may be used. The channel (110) may further have a width that extends along a portion of the circumference of the body (104). The channel (110) may have a width from about 5% to about 50% of the circumference of the body (104), such about 5% to 25%. For instance, the channel may have a width of from about 1 inch to about 3 inches, though other suitable dimensions may be used. The channel (110) may have a depth from about 5% to about 50% of the diameter of the body (104), such as about 33%. For instance, the channel (110) may have a depth of about 1 inch, though other suitable dimensions may be used. Accordingly, the channel (110) may be rotated about the longitudinal axis of the valve (102) from about 0 degrees to about 360 degrees, such that the channel (110) may be positioned at about 0 degrees, about 90 degrees, about 180 degrees, and/or about 270 degrees. While the illustrated embodiment shows the valve (102) having one channel (112), in some other versions, one valve (102) may have more than one channel (110) extending within the valve (102) that are spaced apart longitudinally along the valve (102) and/or rotationally offset relative to each other about the valve (102).

Figure 8A:
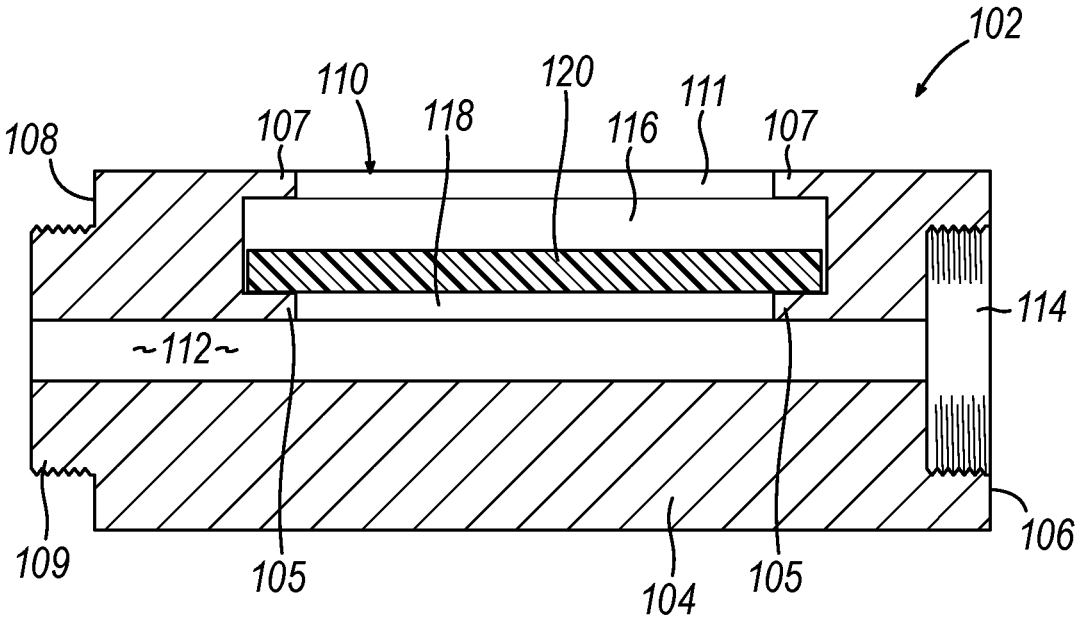
FIG. 8A is a cross-sectional view of the valve of FIG. 5 taken along line 8A-8A of FIG. 7, showing a plunger of the valve in a closed position.
Figure 8B:
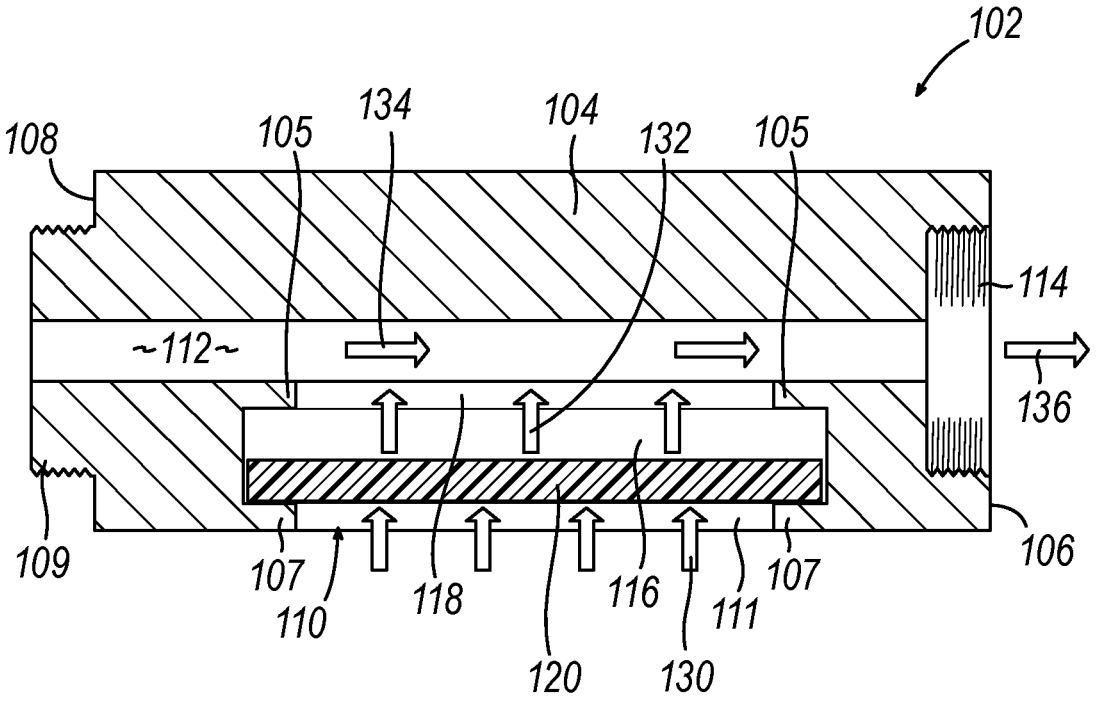
FIG. 8B is a cross-sectional view of the valve of FIG. 8A, showing the plunger of the valve in an open position.
Figure 9A:
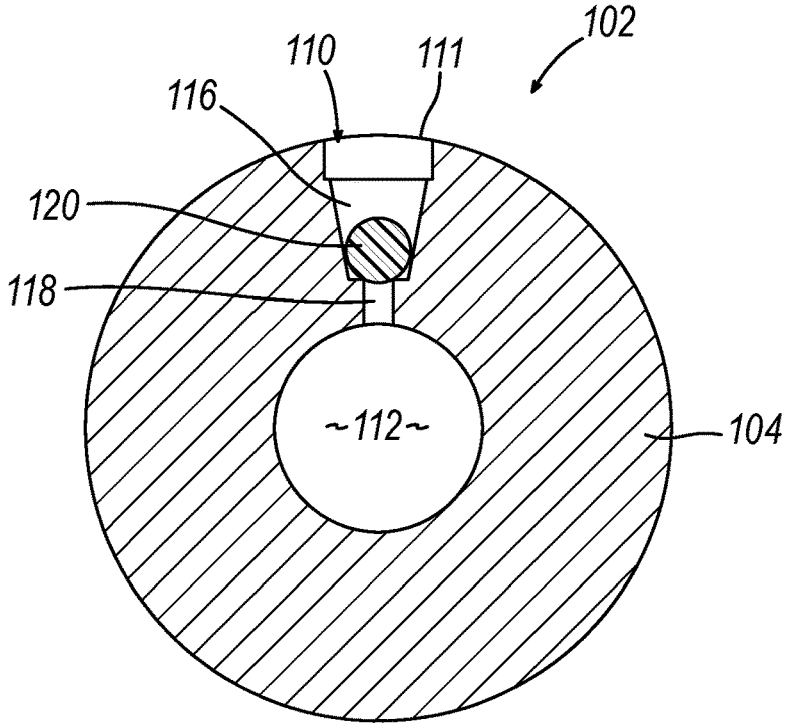
FIG. 9A is a cross-sectional view of the valve of FIG. 5 taken along line 9A-9A of FIG. 7, showing the plunger of the valve in the closed position.
Figure 9B:
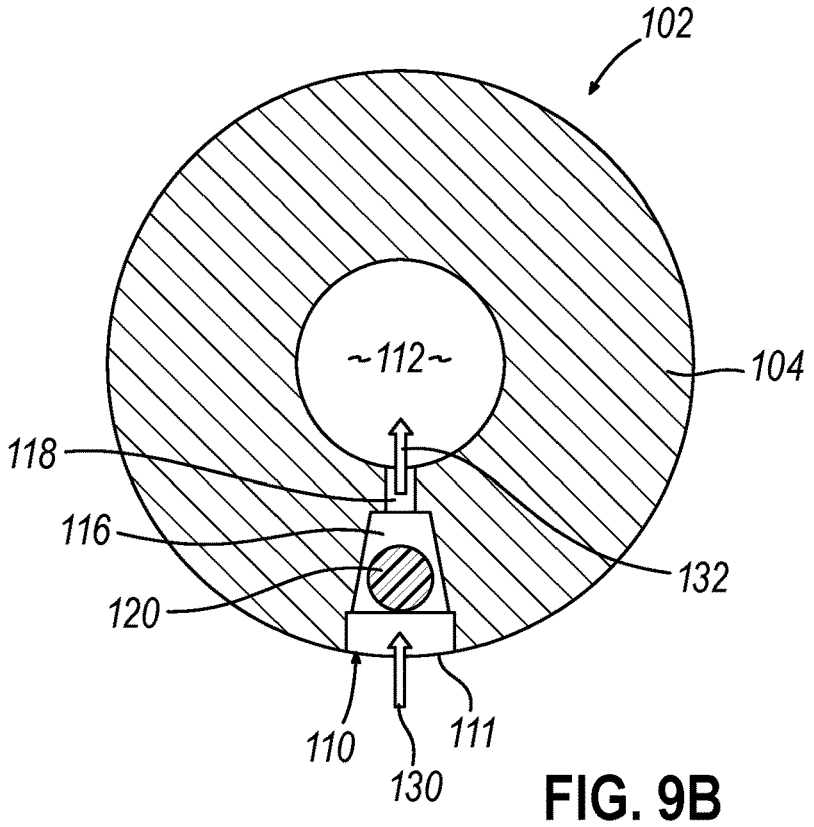
FIG. 9B is a cross-sectional view of the valve of FIG. 9A, showing the plunger of the valve in the open position.

Referring to FIGS. 8A-9B, the channel (110) includes an outer opening (111) extending inward from an exterior surface of the body (104), a groove (116) extending inward from the outer opening (111), and an inner opening (118) extending inward from the groove (116) to the conduit (112) such that the channel (110) fluidly connects the conduit (112) with the atmosphere. As best seen in FIGS. 8A-8B, the groove (116) has a greater length than the outer opening (111) and the inner opening (118). Accordingly, a pair of inner stops (105) extend inwardly at each end of the inner opening (118) between the groove (116) and the conduit (112). A pair of outer stops (107) likewise extend inwardly at each end of the outer opening (111) between the groove (116) and the exterior of valve (102). In some other versions, inner stops (105) and/or outer stops (107) may be positioned across a central portion of the inner opening (118) and/or outer opening (111) respectively such that each opening (111, 118) may comprise a plurality of openings. Referring to FIGS. 9A-9B, the inner opening (118) has a smaller width than the outer opening (111). Accordingly, the width of the groove (116) may taper inward from the outer opening (111) to the inner opening (118) such that the groove (116) has a V-shaped cross-section. In some other versions, the groove (116) may have other suitable cross-sectional shapes (e.g., rectangular, cylindrical, U-shaped, etc.). Still other suitable configurations for the channel (110) will be apparent to one with ordinary skill in the art in view of the teachings herein.

The valve (102) further comprises a plunger (120) positioned within the groove (116). In the illustrated embodiment, the plunger (120) is a generally cylindrical bar. As best seen in FIGS. 8A-8B, the plunger (120) is sufficiently sized to have a smaller length than the groove (116) and a larger length than the outer opening (111) and the inner opening (118). Accordingly, the plunger (120) may freely translate inwardly and/or outwardly within the groove (116) in response to gravitational forces. The plunger (120) is thereby contained within the groove (116) by inner and outer stops (105, 107). In some versions, the plunger (120) has a length from about 1.5 to about 2 feet and an outer diameter of about 0.5 inches, though other suitable dimensions can be used. Accordingly, the plunger (120) may have a width from about 10% to about 99% of the width of the channel (110), such as about 50%, though other suitable dimensions may be used. As best seen in FIGS. 9A-9B, the plunger (120) has a smaller diameter or width than the outer opening (111) and the groove (116). The plunger (120) also has a larger diameter or width than the inner opening (118). Accordingly, when the plunger (120) is positioned inward within the groove (116), the plunger (120) is configured to cover and/or seal the inner opening (118). When the plunger (120) is positioned outward within the groove (116), the plunger (120) is configured to uncover and/or open the inner opening (118). This may allow the plunger (120) to selectively seal the inner opening (118) when the valve (102) is rotated about the longitudinal axis of the valve (102).

Figure 10A:
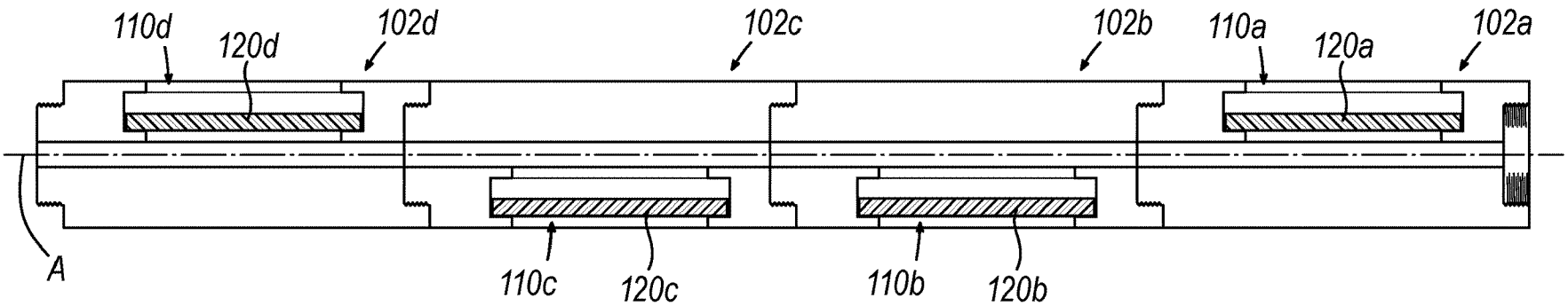
FIG. 10A is a front view of the horizontal gas and liquid bypass separator of FIG. 4, showing a body of the separator as transparent for illustrative purposes.
Figure 10B:
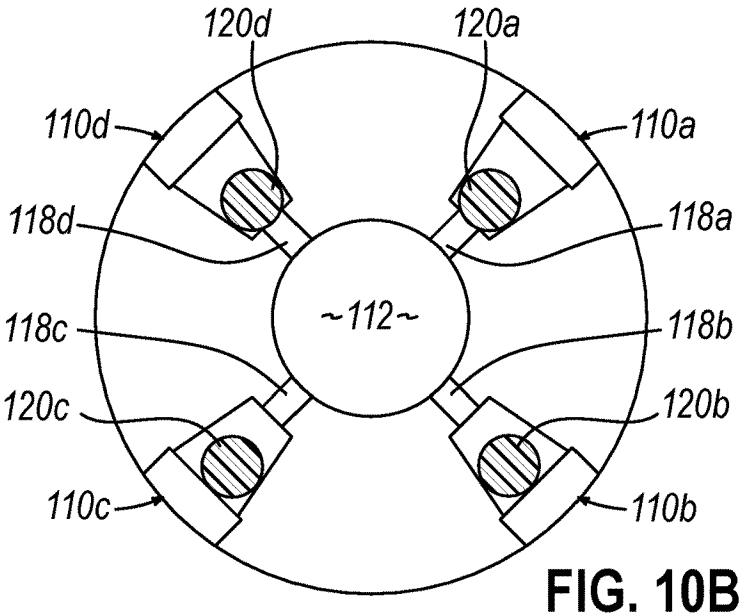
FIG. 10B is an end view of the horizontal gas and liquid bypass separator of FIG. 4, showing the body of the separator as transparent for illustrative purposes.

Referring to FIGS. 2, 4 and 8A-10B, the separator (100) may be used to separate gas from liquid in a horizontal portion (14) of a well bore (10) to improve efficiency and extend the life of the pump (42). For instance, one or more valves (102) may be assembled together to form the separator (100). In the illustrated embodiment, four valves (102*a*, 102*b*, 102*c*, 102*d*) are assembled by threading the protrusion (109) of one valve (102) within a recess (114) of an adjacent valve (102) to maintain the rotational position of the valves (102) relative to each other. Each of the valves (102*a*, 102*b*, 102*c*, 102*d*) may be offset about 90 degrees relative to each other along the longitudinal axis (A) of the separator (100). The separator (100) may then be positioned within the well bore (10). When the separator (100) is placed in the well bore (10), the valves (102) of the separator (100) may be rotated or oriented at any position within the well bore (10). For illustrative purposes, as shown in FIG. 2, the separator (100) is positioned within the generally horizontal portion (14) where the first valve (102*a*) is positioned at about 90 degrees relative to the longitudinal axis (A), the second valve (102*b*) is positioned at about 180 degrees relative to the longitudinal axis (A), the third valve (102*c*) is positioned at about 270 degrees relative to the longitudinal axis (A), and the fourth valve (102*d*) is positioned at about 0 degrees relative to the longitudinal axis (A). Alternatively, as shown in FIGS. 10A-10B, the separator (100) is positioned where the first valve (102*a*) is positioned at about 45 degrees relative to the longitudinal axis (A), the second valve (102*b*) is positioned at about 135 degrees relative to the longitudinal axis (A), the third valve (102*c*) is positioned at about 225 degrees relative to the longitudinal axis (A), and the fourth valve (102*d*) is positioned at about 315 degrees relative to the longitudinal axis (A). Referring back to FIG. 2, the longitudinal axis (A) of the separator (100) is positioned substantially parallel to the longitudinal axis of the generally horizontal portion (14) of the well bore (10). In some other versions, the separator (100) is transversely positioned relative to the longitudinal axis of the generally horizontal portion (14) of the well bore (10). The first end (106) of the first valve (102*a*) may be coupled with an open end of the tubing string (40) to fluidly connect each conduit (112) of the valves (102*a*, 102*b*, 102*c*, 102*d*) with the tubing string (40). The second end (108) of the fourth valve (102*d*) may be sealed or covered to inhibit gas within the well bore (10) from entering the conduit (112) of the fourth valve (102*d*).

Accordingly, at least a bottom portion of the separator (100) may be submerged within the liquid (54) of the generally horizontal portion (14) of the well bore (10). When the pump (42) of the artificial lift is actuated, the valves (102*a*, 102*b*, 102*c*, 102*d*) having the channel (110*a*, 110*b*, 110*c*, 110*d*) positioned in a downward position (e.g., between about 91 degrees and about 269 degrees, such as about 180 degrees) allow gravity to translate the plunger (120) within the channel (110*a*, 110*b*, 110*c*, 110*d*) outward to thereby open the channel (110*a*, 110*b*, 110*c*, 110*d*) and allow the liquid (54) within the well bore (10) to flow through the conduit (112) of the valves (102*a*, 102*b*, 102*c*, 102*d*) and into the pump intake via the velocity string (40). The valves (102*a*, 102*b*, 102*c*, 102*d*) having the channel (110*a*, 110*b*, 110*c*, 110*d*) positioned in an upward position (e.g., between about 270 degrees and about 90 degrees, such as about 0 degrees) allow gravity to translate the plunger (120) within the channel (110*a*, 110*b*, 110*c*, 110*d*) inward to thereby block the channel (110*a*, 110*b*, 110*c*, 110*d*) and inhibit gas (52) from entering the conduit (112) of the valves (102*a*, 102*b*, 102*c*, 102*d*). Accordingly, the gas (52) moves across a top of the separator (100) to bypass the pump intake. This prevents free gas from entering the pump intake to increase the efficiency of the pump (42).

Referring to FIGS. 8A and 9A, when the channel (110) of the valve (102) is positioned in an upward position, gravitational forces may act on the plunger (120) of the valve (102) to translate the plunger (120) inward within the groove (116) of the valve (102). The side surfaces of the groove (116) may direct the plunger (120) to the central portion of the groove (116) such that the plunger (120) may thereby cover and/or seal the inner opening (118) of the valve (102). With the inner opening (118) of the valve (102) covered and/or sealed, the plunger (120) may inhibit gas (52) in the well bore (10) from entering the conduit (112) of the valve (102). Accordingly, referring to FIGS. 10A-10B, the first and fourth valves (102*a*, 102*d*) are positioned in an upward position such that the plungers (120*a*, 120*d*) are translated inward to inhibit gas (52) from entering the conduit (112) of the separator (100).

Referring to FIGS. 8B and 9B, when the channel (110) of the valve (102) is positioned in a downward position, gravitational forces may act on the plunger (120) of the valve (102) to translate the plunger (120) outward within the groove (116) of the valve (102). The plunger (120) may thereby uncover and/or unseal the inner opening (118) of the valve (102). With the inner opening (118) of the valve (102) uncovered and/or unsealed, the plunger (120) may allow liquid (54) in the well bore (10) to enter the conduit (112) of the valve (102). For instance, as shown be arrow (130), liquid (54) is permitted to flow into the outer opening (111) of the channel (110) and around the plunger (120). The liquid (54) may then flow through the groove (116) and inner opening (118), as shown by arrow (132), and into the conduit (112). Referring to FIGS. 10A-10B, the second and third valves (102*b*, 102*c*) are positioned in an downward position such that the plungers (120*b*, 120*c*) are translated outward to allow liquid (54) to enter the conduit (112) of the separator (100).

Referring back to FIGS. 8B and 9B, the liquid (54) may then be pumped by the artificial lift mechanism through the conduit (112), as shown by arrow (134), and out of the conduit (112), as shown by arrow (136). Accordingly, the liquid (54) may flow through the next adjacent valve (102) and/or through the tubing string (40) to the surface (24). The separator (100) thereby allows gas (52) to bypass over the top of the separator (100) in a generally horizontal portion (14) of a well bore (10), while allowing liquid (54) to flow through the separator (100) to the pump (42). Still other suitable configurations and methods for operating the separator (100) may be used as will be apparent to one with ordinary skills in the art in view of the teachings herein.

For instance, the separator (100) may include any suitable number of valves (102) coupled together to form the separator (100). Each of these valves may have any suitable number of channels (110) that may be positioned about the body (104) of the separator (100) in any suitable pattern circumferentially and/or longitudinally. Accordingly, a single separator (100) may be positioned within a well bore (10) and/or multiple separators (100) could be used within the well bore (10). Such separators (100) could be assembled together and/or spaced at various positions along the tubing string (40).

Figure 12:
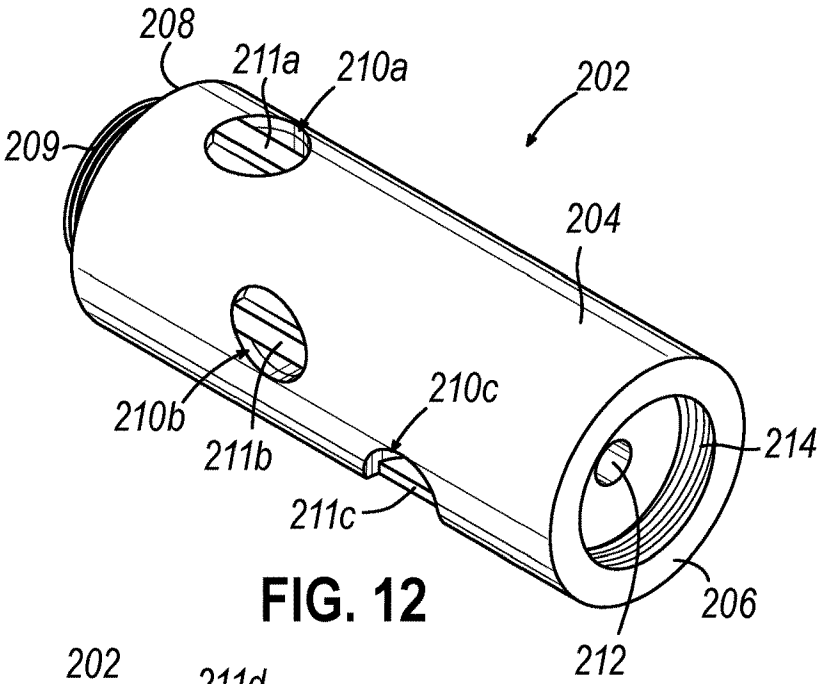
FIG. 12 is a right perspective view of the valve of FIG. 11.
Figure 11:
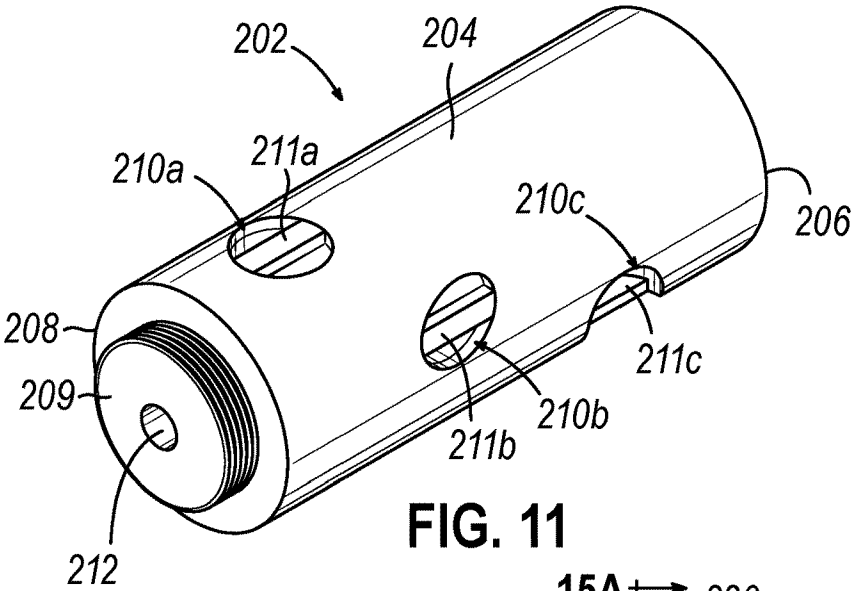
FIG. 11 is a left perspective view a second exemplary valve that can be incorporated into the horizontal gas and liquid bypass separator of FIG. 4.
Figure 13:
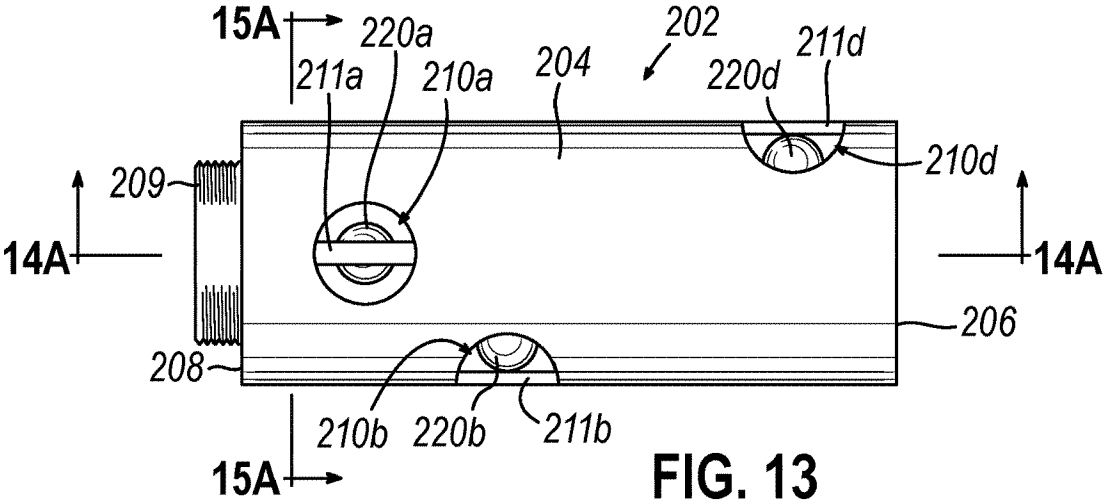
FIG. 13 is a top plan view of the valve of FIG. 11.

B. Exemplary Horizontal Gas and Liquid Bypass Separator Having a Ball and Seat Plunger Referring to FIGS. 11-13, a second exemplary valve (202) is shown according to the concepts described herein for use in the separator (100). While a single valve (202) is described below, it should be noted that the valve (202) may be incorporated as one or more valves (102*a*, 102*b*, 102*c*, 102*d*) of the separator (100). The valve (202) is similar to valve (102) except that valve (202) includes a plunger (220) having a ball and seat configuration instead of a bar configuration.

In the illustrated embodiment, valve (202) comprises a body (204) defining a conduit (212) extending longitudinally therethrough from a first end (206) of the valve (202) to a second end (208) of the valve (202). The first end (206) may include a recess (214) extending inward from the first end (206) within a portion of the body (204). The second end (208) may include a protrusion (209) extending outward from the second end (208). The protrusion (209) and recess (214) may be sufficiently sized such that the recess (214) is configured to receive a protrusion (209) from an adjacent valve (202) to assemble the valves (202) together. Accordingly, each valve (202) may be selectively coupled with another valve (202). In the illustrated embodiment, the recess (214) and the protrusion (209) are threaded such that the recess (214) may be threadably secured to a protrusion (209) to maintain the rotational position of the recess (214) relative to the protrusion (209). Still other suitable couplings can be used to assembly adjacent valves (202) together, such as a friction fit, a keyed coupling, etc. The valve (202) may be made from stainless steel, or any other suitable material.

The valve (202) further comprises at least one channel (210*a*, 210*b*, 210*c*, 210*d*) extending inward through at least a portion of the body (204) from an exterior surface of the valve (202) to the conduit (212). Referring to FIGS. 14A-15B, each channel (210*a*, 210*b*, 210*c*, 210*d*) is formed by a tube (213) extending inward from the body (204) of the valve (202). In the illustrated embodiment, each tube (213) is generally cylindrical, though any other suitable shape may be used. An interior portion of each tube (213) includes a tapered portion (217) that narrows inward such that an end surface (215) of the tapered portion (217) defines an inner opening (219). Accordingly, the inner opening (219) has a smaller diameter than channel (210). In the illustrated embodiment, four channels (210*a*, 210*b*, 210*c*, 210*d*) are shown longitudinally and circumferentially spaced about the body (204). For instance, a first channel (210*a*) is positioned at about 0 degrees about the longitudinal axis of the valve (202), a second channel (210*b*) is positioned distally relative to the first channel (210*a*) at about 90 degrees about the longitudinal axis of the valve (202), a third channel (210*c*) is positioned distally relative to the second channel (210*b*) at about 180 degrees about the longitudinal axis of the valve (202), and a fourth channel (210*d*) is positioned distally relative to the third channel (210*c*) at about 270 degrees about the longitudinal axis of the valve (202).

In some other versions, the valve (202) may include more or less channels (210*a*, 210*b*, 210*c*, 210*d*) and/or one or more channels (210*a*, 210*b*, 210*c*, 210*d*) may be longitudinally and/or laterally aligned relative to each other. Each channel (210*a*, 210*b*, 210*c*, 210*d*) may have a width from about 5% to about 50% of the circumference of the body (204), such about 5% to 25%. Each channel (210*a*, 210*b*, 210*c*, 210*d*) may have a width of from about 1 inch to about 3 inches, though other suitable dimensions may be used. Each tube (213) may have a depth from about 5% to about 50% of the diameter of the body (204), such as about 33%. Each tube (213) may have a depth of about 1 inch, though other suitable dimensions may be used. Accordingly, each tube (213) may be rotated about the longitudinal axis of the valve (202) from about 0 degrees to about 360 degrees, such that the tube (213) may be positioned at about 0 degrees, about 90 degrees, about 180 degrees, and/or about 270 degrees.

Figure 14A:
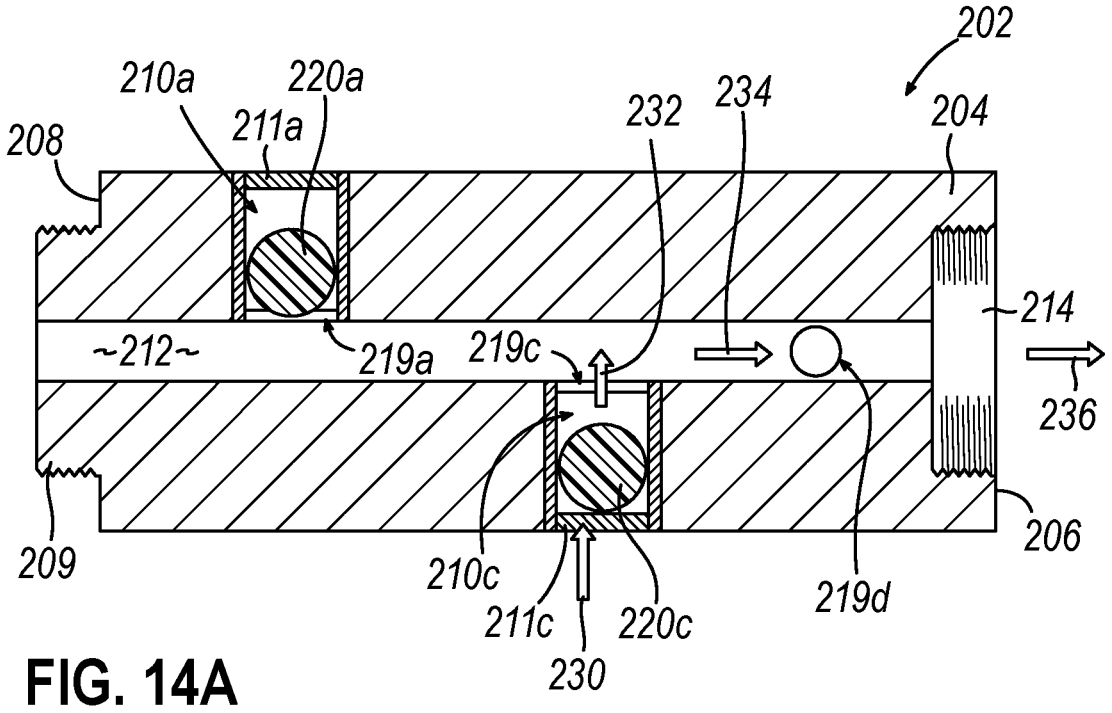
FIG. 14A is a cross-sectional view of the valve of FIG. 11 taken along line 14A-14A of FIG. 13.
Figure 14B:
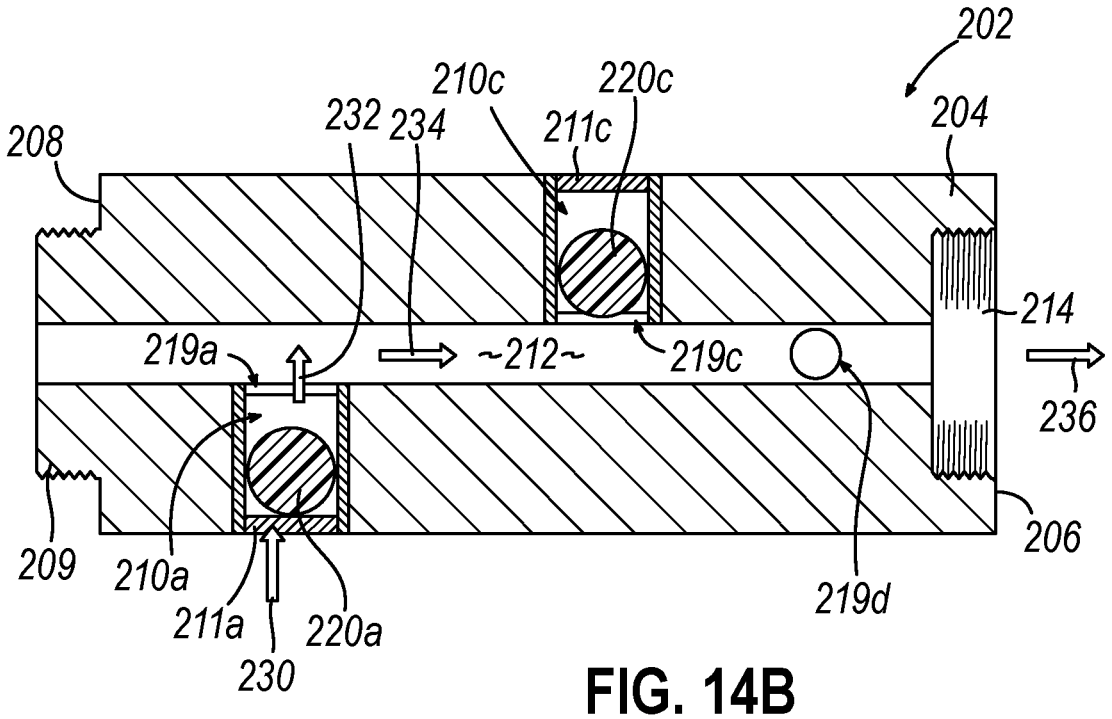
FIG. 14B is a cross-sectional view of the valve of FIG. 14A, with the valve rotated about 180 degrees about a longitudinal axis of the valve.
Figure 15B:
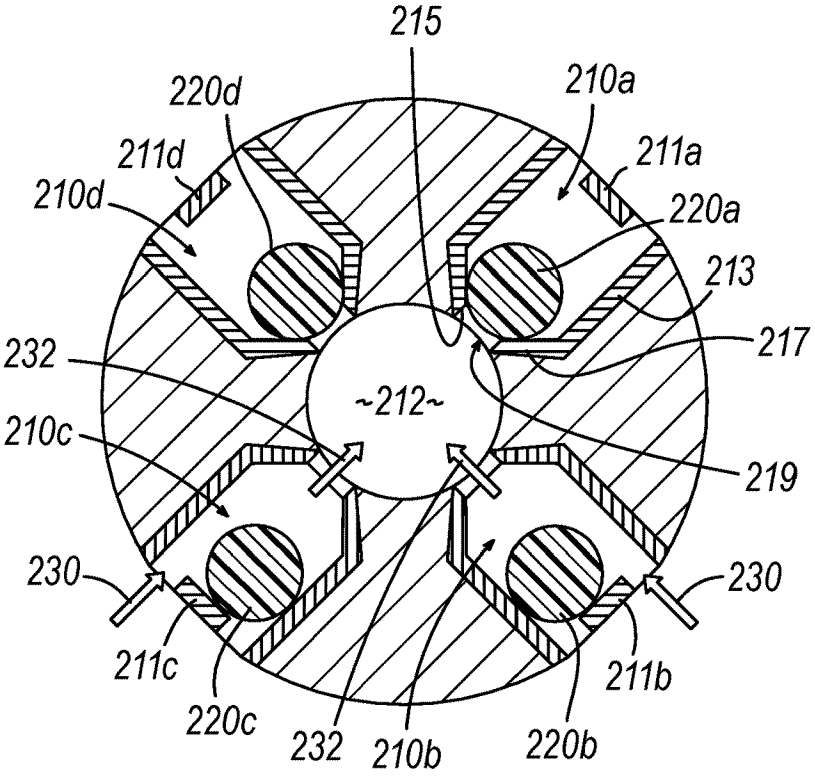
FIG. 15B is a cross-sectional view of the valve of FIG. 15A, with the valve rotated about 45 degrees about the longitudinal axis of the valve.
Figure 15A:
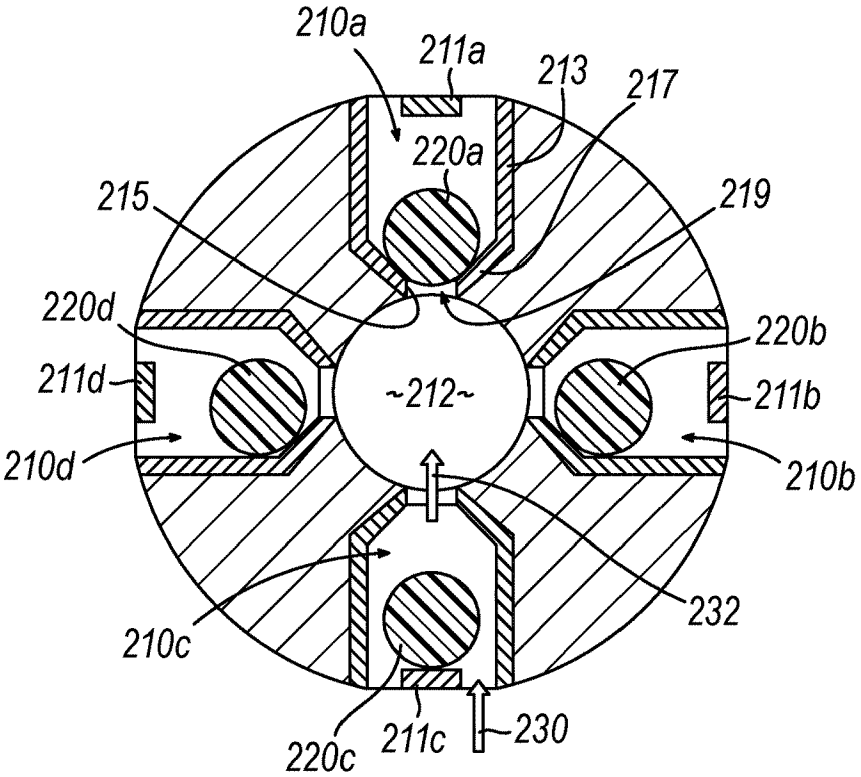
FIG. 15A is a cross-sectional view of the valve of FIG. 11 taken along line 15A-15A of FIG. 11.

As best seen in FIGS. 11-13 and 15A-15B, each channel (210*a*, 210*b*, 210*c*, 210*d*) includes at least one stop (211*a*, 211*b*, 211*c*, 211*d*) extending across a top portion of the channel (210*a*, 210*b*, 210*c*, 210*d*). The stop (211*a*, 211*b*, 211*c*, 211*d*) has a smaller width than the diameter of the channel (210*a*, 210*b*, 210*c*, 210*d*). The valve (202) further comprises a plunger (220*a*, 220*b*, 220*c*, 220*d*) positioned within each channel (210*a*, 210*b*, 210*c*, 210*d*). In the illustrated embodiment, the plunger (220*a*, 220*b*, 220*c*, 220*d*) is a generally spherical ball. As best seen in FIGS. 14A-15B, each plunger (220*a*, 220*b*, 220*c*, 220*d*) is sufficiently sized to have a smaller diameter than the channel (210*a*, 210*b*, 210*c*, 210*d*) and a larger diameter than the inner opening (219). Accordingly, the plunger (220*a*, 220*b*, 220*c*, 220*d*) may freely translate inwardly and/or outwardly within the channel (210*a*, 210*b*, 210*c*, 210*d*) due to gravitational forces. The plunger (220*a*, 220*b*, 220*c*, 220*d*) is contained within the channel (210*a*, 210*b*, 210*c*, 210*d*) by stop (211*a*, 211*b*, 211*c*, 211*d*) at an outer portion of the channel (210*a*, 210*b*, 210*c*, 210*d*) and by tapered portion (217) at an inner portion of the channel (210*a*, 210*b*, 210*c*, 210*d*). In some versions, the plunger (220*a*, 220*b*, 220*c*, 220*d*) has an outer diameter of about 0.5 inches, though other suitable dimensions can be used. As best seen in FIGS. 15A-15B, when the plunger (220*a*, 220*b*, 220*c*, 220*d*) is positioned inward within the channel (210*a*, 210*b*, 210*c*, 210*d*), the plunger (220*a*, 220*b*, 220*c*, 220*d*) is configured to cover and/or seal the inner opening (219). When the plunger (220*a*, 220*b*, 220*c*, 220*d*) is positioned outward within the channel (210*a*, 210*b*, 210*c*, 210*d*), the plunger (220*a*, 220*b*, 220*c*, 220*d*) is configured to uncover and/or open the inner opening (219). This may allow the plunger (220*a*, 220*b*, 220*c*, 220*d*) to selectively seal the inner opening (219) when the valve (202) is rotated about the longitudinal axis of the valve (202).

Referring to FIGS. 2 and 14A-15B, the one or more valves (202) may be incorporated into the separator (100) to separate gas from liquid in a horizontal portion (14) of a well bore (10) to improve efficiency and extend the life of the pump (42). For instance, a valve (202) having a channel (210*a*, 210*b*, 210*c*, 210*d*) positioned in an upward position (e.g., between about 270 degrees and about 90 degrees, such as about 0 degrees) may inhibit gas (52) within the well bore (10) from entering the separator (100), while valves (202) having the channel (210*a*, 210*b*, 210*c*, 210*d*) positioned in a downward position (e.g., between about 91 degrees and about 269 degrees, such as about 180 degrees) may allow liquid (54) within the well bore (10) to enter the separator (100). Referring to FIGS. 14A and 15A for illustrative purposes, when the first channel (210*a*) of the valve (202) is positioned in an upward position, gravitational forces may act on the plunger (220*a*) of the valve (202) to translate the plunger (220*a*) inward within the first channel (210*a*). The tapered portion (217) of the tube (213) may direct the plunger (220*a*) to the central portion of the first channel (210*a*) such that the plunger (220*a*) may thereby cover and/or seal the inner opening (219) of the valve (202). With the inner opening (219) of the valve (202) covered and/or sealed, the plunger (220*a*) may inhibit gas (52) in the well bore (10) from entering the conduit (212) of the valve (202) via the first channel (210*a*).

Referring to FIG. 14B, the first channel (210*a*) of the valve (202) may be rotated to a downward position such that gravitational forces may act on the plunger (220*a*) of the valve (202) to translate the plunger (220*a*) outward within the first channel (210*a*) to stop (211*a*). The plunger (220*a*) may thereby uncover and/or unseal the inner opening (219) of the valve (202). With the inner opening (219) of the valve (202) uncovered and/or unsealed, the plunger (220*a*) may allow liquid (54) in the well bore (10) to enter the conduit (212) of the valve (202) via the first channel (210*a*). For instance, as shown by arrow (230), liquid (54) is permitted to flow about the stop (211*a*) and the plunger (220*a*), into the first channel (210*a*). The liquid (54) may then flow through the first channel (210*a*) and inner opening (219), as shown by arrow (232), and into the conduit (212). The liquid (54) may then be pumped by the artificial lift mechanism through the conduit (212), as shown by arrow (234), and out of the conduit (212), as shown by arrow (236). Accordingly, the liquid (54) may flow through the next adjacent valve (202) and/or through the tubing string (40) to the surface (24).

Additionally or alternatively, the valve (202) may be rotated within the well bore (10) to position one or more conduits (210*a*, 210*d*) in the upward position and one or more conduits (210*b*, 210*c*) in the downward position. For instance, as shown in FIG. 15B, the first and fourth channels (210*a*, 210*d*) are in the upward position and the second and third channels (210*b*, 210*c*) are in the downward position. Accordingly, the plungers (220*a*, 220*d*) of the first and fourth channels (210*a*, 210*d*) may be translated inward to substantially seal the respective inner opening (219) of the channels (210*a*, 210*d*). The plungers (220*b*, 220*c*) of the second and third channels (210*b*, 210*c*) may be translated outward to uncover the inner opening (219) of the respective channels (210*b*, 210*c*). This may allow liquid (54) to enter the second and third channels (210*b*, 210*c*), while the first and fourth channels (210*a*, 210*d*) are sufficiently sealed to allow gas (52) to bypass over the top portion of the valve (202). Still other suitable configurations and methods for operating the valve (202) may be used as will be apparent to one with ordinary skills in the art in view of the teachings herein.

For instance, the separator (100) may include any suitable number of valves (202) coupled together to form the separator (100). Each of these valves may have any suitable number of channels (210) that may be positioned about the body (204) of the separator (100) in any suitable pattern circumferentially and/or longitudinally. Accordingly, a single separator (100) may be positioned within a well bore (10) and/or multiple separators (100) could be used within the well bore (10). Such separators (100) could be assembled together and/or spaced at various positions along the tubing string (40).

Figure 16:
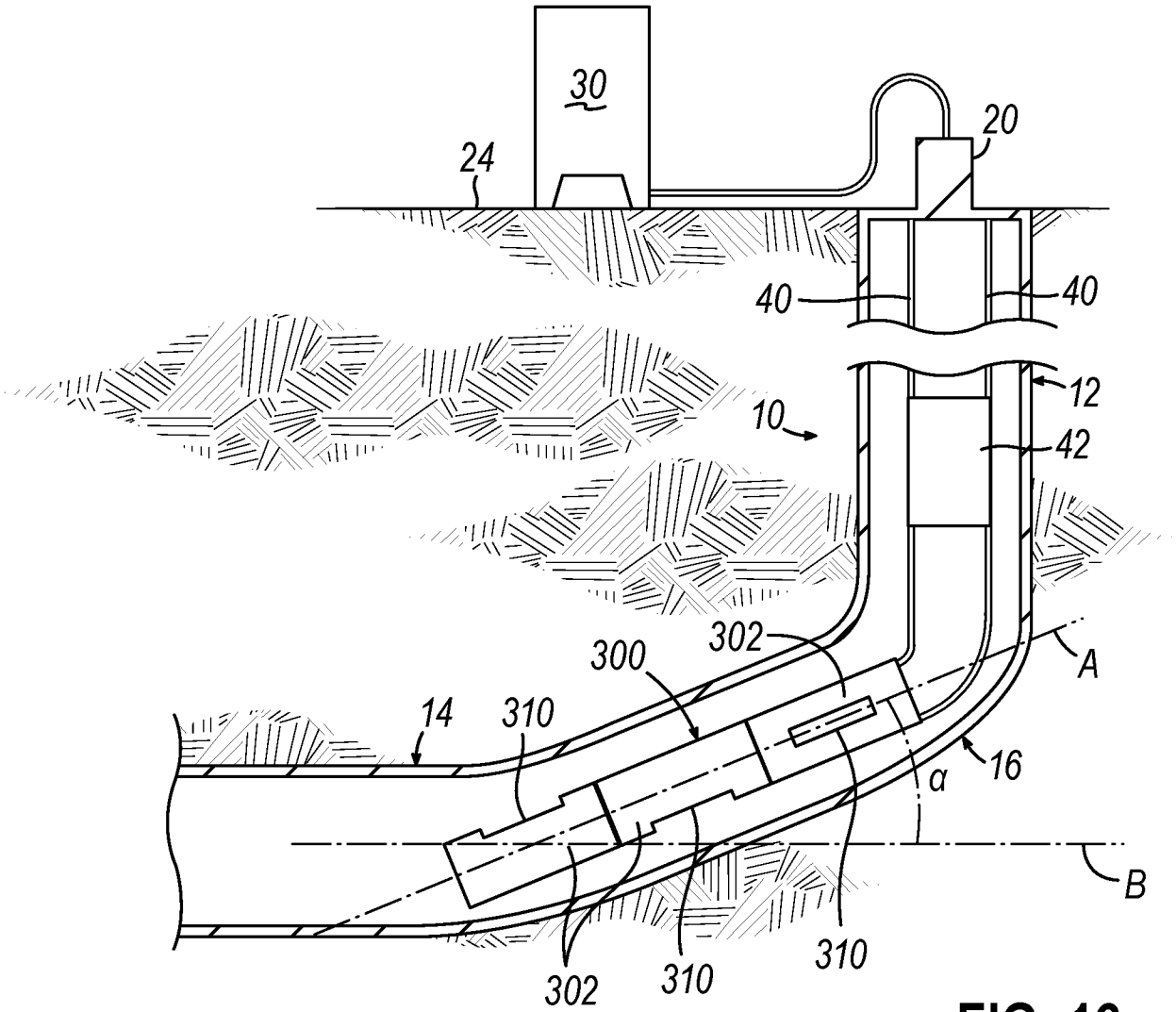
FIG. 16 is a schematic of the well bore of FIG. 2 showing a second exemplary horizontal gas and liquid bypass separator positioned within a generally curved portion of the well bore.

II. Exemplary Well Bore Assembly Having an Angularly Positioned Horizontal Gas and Liquid Bypass Separator In some versions, at least a portion of the separator (100) may be positioned within the generally vertical portion (12), the generally curved portion (16), and/or the generally horizontal portion (14). For instance, the separator (100) may be positioned at an angle within the well bore (10). Referring to FIG. 16, a second exemplary separator (300) is shown that is similar to the separator (100) described above. The separator (300) includes one or more valves (302) assembled together with each channel (310) of the valves (302) rotationally offset relative to each other. In the illustrated embodiment, the separator (300) is positioned within the well bore (10) with a longitudinal axis (A) of the separator (300) at an angle ($\alpha$) transverse to a longitudinal axis (B) of the generally horizontal portion (14) of the well bore (10). The angle ($\alpha$) may be any sufficient angle that allows the plunger (120, 220) to translate within the channel (310) of the valve (302) in response to gravitational forces. For instance, the separator (300) may be positioned at an angle ($\alpha$) from about 0 degrees to about 90 degrees, such as from about 0 degrees to about 45 degrees. In the illustrated embodiment, the separator (300) thereby extends through the generally curved portion (16) of the well bore (10). In some other versions, the separator (300) may be positioned in one or more of the generally vertical portion (12), the generally curved portion (16), and/or the generally horizontal portion (14) at an angle (α). Still other suitable configurations for the separator (300) will be apparent to one with ordinary skill in the art in view of the teachings herein.

For instance, each valve (302) of the separator (300) may be spaced apart relative to each other with the tubing string (40) and/or other suitable tubing positioned between the valves (302) to couple the valves (300) together. Accordingly, each valve (302) may be positioned at an angle (α) within the well bore (10) such that each valve (302) may be positioned at a different angle (α) than the other valves (302) of the separator (300). The separator (300) may thereby be positioned to extend through the well bore (10) in one or more of the generally vertical portion (12), the generally curved portion (16), and/or the generally horizontal portion (14) with each valve (302) positioned at an angle (α).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A separator for use in a well bore, wherein the separator comprises at least one valve, wherein the at least one valve comprises:

a body extending along a longitudinal axis from a first end to a second end of the body;

a conduit extending longitudinally through the body from the first end to the second end of the body;

an elongated channel extending laterally through the body from an outer surface of the body to the conduit and longitudinally along the length of the body;

a pair of inner stops positioned at each end of the elongated channel adjacent to the conduit;

a pair or outer stops positioned at each end of the elongated channel adjacent to the exterior surface of the body; and a cylindrical plunger positioned within the elongated channel such that the plunger is translatable inwardly and outwardly within the elongated channel to selectively seal the conduit relative to the elongated channel, wherein the cylindrical plunger is longer then the length of the elongated channel such that the pair of inner stops engages ends of the cylindrical plunger;

wherein the plunger is translatable inward within the elongated channel towards the longitudinal axis to a closed position such that the plunger substantially seals the conduit relative to the elongated channel to thereby inhibit gas from entering the conduit, wherein the plunger is translatable outward within the elongated channel away from the longitudinal axis to an open position such that the plunger substantially opens the conduit relative to the elongated channel to thereby allow liquid to enter the conduit.

2. The separator of claim 1, wherein the plunger is translatable in response to gravitational forces, such that the plunger is translated to the closed positioned when the valve is oriented to an upward position with the elongated channel extending generally upward, and such that the plunger is translated to the open position when the valve is oriented to a downward position with the elongated channel extending generally downward.

3. The separator of claim 1, wherein the plunger is configured to substantially cover the elongated channel when the plunger is positioned in the closed position.

4. The separator of claim 1, wherein the channel includes a tapered portion that narrows inwardly from an outer portion of the elongated channel to an inner portion of the channel.

5. The separator of claim 1, wherein the valve includes a plurality of elongated channels extending through the body, wherein the plurality of elongated channels are circumferentially spaced apart relative to each other.

6. The separator of claim 5, wherein multiple separators are attached end to end.

7. A separator assembly for use in a well bore comprising:

a first valve segment and a second valve segment coupled together along a longitudinal axis of the separator assembly, wherein each of the first and second valve segments comprise:

a body extending along the longitudinal axis from a first end to a second end of the body, a conduit extending longitudinally through the body from the first end to the second end of the body;

a channel extending laterally through the body from an outer surface of the body to the conduit, and a plunger positioned within the channel such that the plunger is translatable inwardly and outwardly within the channel to selectively seal the conduit relative to the channel, wherein the plunger is translatable inward within the channel towards the longitudinal axis to a closed position such that the plunger substantially seals the conduit relative to the channel, wherein the plunger is translatable outward within the channel away from the longitudinal axis to an open position such that the plunger substantially opens the conduit relative to the channel;

wherein the first valve is rotationally offset relative to the second valve about the longitudinal axis such that the first valve is positioned in the closed position when the second valve is positioned in the open position.

8. The separator assembly of claim 7, wherein the first valve comprises a recess extending inwardly within the first end of the body, wherein the second valve comprises a protrusion extending outwardly from the second end of the body, wherein the recess of the first valve is sufficiently sized to receive the protrusion of the second valve.

9. The separator assembly of claim 8, wherein the recess of the first valve is threadably secured with the protrusion of the second valve to maintain the position of the first valve relative to the second valve.

10. The separator assembly of claim 7, wherein the second valve is rotated about 90 degrees relative to first valve about the longitudinal axis.

11. The separator assembly of claim 7, wherein the first valve is positioned in an upward position with the channel of the first valve extending generally upward such that the plunger of the first valve is in the closed position, wherein the second valve is positioned in a downward position with the channel of the second valve extending generally downward such that the plunger of the second valve is in the open position.

* * * * *